US005467816A

United States Patent [19]

Larinoff

[11] Patent Number: 5,467,816

[45] Date of Patent: Nov. 21, 1995

[54] FINNED TUBES FOR AIR-COOLED STEAM CONDENSERS

[76] Inventor: Michael W. Larinoff, 370 Holly Hill Rd., Oldsmar, Fla. 34677

[21] Appl. No.: 14,620

[22] Filed: Feb. 8, 1993

[51] Int. Cl.[6] ..... F28F 1/20

[52] U.S. Cl. ..... 165/151; 165/181; 165/182

[58] Field of Search ..... 165/181, 182, 165/135, 151

[56] References Cited

U.S. PATENT DOCUMENTS

| | | | |
|---|---|---|---|
| 1,766,701 | 6/1930 | Blackmore | 165/182 |
| 2,204,332 | 6/1940 | Trent | 165/181 |
| 2,853,279 | 9/1958 | Switzer | 165/135 |
| 2,965,357 | 12/1960 | Modine | 165/151 |
| 2,983,483 | 5/1961 | Modine | 165/151 |
| 3,149,667 | 9/1964 | Astrup | 165/181 |
| 3,266,567 | 8/1966 | Oddy et al. | 165/182 |
| 3,623,548 | 11/1971 | Cook | 165/135 |
| 3,687,194 | 8/1972 | Schöll | 165/182 |
| 3,780,797 | 12/1973 | Gebelius | 165/182 |
| 4,771,825 | 9/1988 | Chen et al. | 165/181 |
| 4,928,756 | 5/1990 | Shull et al. | 165/182 |
| 4,997,036 | 3/1991 | Schulze et al. | 165/182 |

FOREIGN PATENT DOCUMENTS

| | | | |
|---|---|---|---|
| 1457587 | 9/1966 | France | 165/181 |
| 929521 | 6/1955 | Germany | 165/182 |
| 8965 | 7/1956 | Germany | 165/181 |
| 43292 | 2/1992 | Japan | 165/182 |
| 359102 | 10/1931 | United Kingdom | 165/181 |
| 2088544 | 6/1982 | United Kingdom | 165/181 |

*Primary Examiner*—John Rivell
*Assistant Examiner*—L. R. Leo
*Attorney, Agent, or Firm*—Dominik, Stein, Saccocio, Reese, Colitz & Van Der Wall

[57] ABSTRACT

A low cost, extended surface, finned-tube of rectangular cross-section is disclosed for use in single-row bundles of the type used in power plant air-cooled steam condensers. The steel U-shaped fins are metallurgically bonded to the steel tubes by hot-dip galvanizing; aluminum fins would be brazed on. The bottom section of the tubes that flow the condensate have a built-in freeze protection feature.

6 Claims, 4 Drawing Sheets

FINNED TUBES FOR AIR-COOLED STEAM CONDENSERS

BACKGROUND OF THE INVENTION

1. Summary of the Invention

This application relates to finned tubes for and, more particularly, to air-cooled heat exchange equipment condensing steam or other such vapors that employ extended-surface fins attached by metallurgical bonding to fluid-flowing tubes.

2. Summary of the Background Art

This application describes the design and fabrication of finned tube of the type used but not described in U.S. Pat. No. 5,139,083 issued Aug. 18, 1992. More specifically, the invention of the instant application relates to cost-related improvements in the design and fabrication of metallurgically-bonded finned tubes that are used in the assembly of air-cooled heat exchange bundles. These are the bundles which make up the bulk of air-cooled steam condensers of the type employed in steam-electric power generating stations. The turbine exhaust steam is condensed inside these bundles by forced ambient air flowing over the finned tubes and the condensate is returned to the power plant cycle. In a large power plant there may be as much as 100 miles of such finned tubes condensing the exhaust steam.

The recent trend in bundle design and construction has been toward the use of large tubes with only one or two rows depth. Large single-row tubes are more freeze proof and can be more economic in manufacturing and in their structural support. In addition to low cost and freeze protection, there are the additional goals pursued by manufacturers which are the atmospheric corrosion protection of the fins and tubes and their long term heat transfer rate stability between the tubes and fins. Experience has shown that the most stable fin-tube construction has been found to be the fins that are metallurgically bonded to the tube. The most popular metallurgical bonding process is hot-dip galvanizing in which both the tube and the fins are of steel material. A new bonding process recently used in this field is that of furnace brazing aluminum fins to an aluminized steel tube with a layer of aluminum-silica.

Currently there are two types of steel fin-tube designs that employ hot-dip galvanizing. One uses press-punched fins that are installed by sliding them individually over a horizontal oval-shaped tube and the second type uses a machine that wraps a spiral fin around an oval-shaped tube. Both the methods have their manufacturing problems at high production rates. The problems, however, disappear at lower production rates but at a penalty of higher unit costs.

The more obvious background patents in the field of large steam condensing tubes and bundles are listed below with brief comment on their design features.

1. RUFF, U.S. Pat. No. 3,976,126 has many similar construction features as this application. Its fins, however, envelope the complete tube and are installed over the end of the bare tube. During assembly these fins must be loose enough to slide over the tube yet tight enough to have the fin-tube gap closed by zinc in the hot-dip galvanizing process. Manufacturing dimensional tolerances of the tube make this a very difficult procedure because the fins tend to get hung-up on tight spots that are over-tolerance on the tube during the fin-stacking process. Also, there is a large wastage of sheet metal material in the punching of the oval shaped opening in the fin. This is costly considering that an air-cooled steam condenser serving a large power plant may have over 50 million such fins in a single row bundle design.

2. SAPERSTEIN, U.S. Pat. No. 4,256,177 describes a serpentine fin design and a furnace brazing bonding operation currently used by a condenser manufacturer. The fins are brazed to the two sides of a rectangular shaped tube. There is one fin assembly per tube side and the brazing is done with the fin assembly placed on top of the tube.
3. KLUPPEL, U.S. Pat. No. 4,168,742 shows a tube with parallel side walls and fins in the form of pleats secured to the sides of adjacent tubes. The manufacturing and bonding process of this tube is not described or discussed.
4. GREEVER, U.S. Pat. No. 4,102,027 describes a fin design that is spirally wound about a tubular element with metal-to-metal contact produced by tension forces.
5. HARADA, U.S. Pat. No. 3,916,989
6. FORGO, U.S. Pat. No. 3,135,320
7. GUNTER, U.S. Pat. No. 3,438,433

All three of the above patents describe plate-fin type air-cooled heat exchangers that envelope one or more tubes.

8. WAGNER, British Patent No. 359,102 reveals a finned tube for radiator applications that has an elongated tube and a slotted fin similar to this application. The difference between the two is the design techniques employed to mechanically hold the fins onto the tubes. Wagner holds his fins against the flat walls of the tube by forcing the fins to flex the thin-walled tubes inward slightly. Larinoff employs a middle fin link to mechanically hold the fins into the tubes.
9. KASE, Japan Patent No. 4-43292, has a refrigeration finned tube similar in basic design as Wagner and Larinoff. Kase holds his fins against the flat walls of the tube by the flexing of the 90 degree, bend between the fins and their collars.

Accordingly, it is the object of the present invention to design a fin for a large rectangular shaped tube that is low cost because its design layout is highly efficient in the use of the raw sheet metal material from which the fins are machine punched.

It is the further object of the present invention to devise simple means of mechanically holding the fin onto the tube prior to the metallurgical bonding of the fins to the tube.

It is the further object of the present invention to devise a simple and low cost assembly process for coupling the fins onto the tubes.

It is a further object of the present invention to design and install the finned tubes into condense bundles such as to provide added freeze protection to the condensate draining inside the tubes.

As regards the first object shown above, typical fins on the market today look like U.S. Pat. Nos. 3,976,126 and 4,997,036, copy attached, where the metal material that is punched out to allow for the insertion of the large tube, is scrapped.

The foregoing has outlined some of the more pertinent objects of the present invention. These objects should be construed to be merely illustrative of some of the more prominent features and applications of the intended invention. Many other beneficial results could be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The aim of this invention is to produce a low-cost finned-tube which has its fins metallurgically bonded to the tube such as hot-dip galvanizing. The contemplated savings are in the fabrication of the rectangular tube, the efficient utilization of the sheet metal fin material and the simplicity and speed of installing the fins on the tube in the manufacturing process prior to the bonding.

Oval shaped tubes are generally produced by pulling a shaped mandrel through commercially purchased steel pipe. Alternatively, rectangular tubes can be manufactured from flat sheet-metal stock cut to size and the sides rolled 90 degrees. Two such elements machine-welded at the seams produce a low-cost rectangular tube.

The fins are generally either steel or aluminum stampings punched to size. From a heat transfer aspect, there is no need for the fin to completely circle the tube; in fact it is preferred not to cool the bottom of the tube where the condensate flows. The less heat that is lost by the condensate to the cooling air via the fins the more efficient the power cycle and the more freeze protected the condenser. The U-shaped fin revealed in this invention leaves the bottom of the tube open without fins. In addition, the U-shape allows the efficient utilization of the sheet metal material during the stamping process as will be shown later.

The design and fabrication challenge faced with a U-shaped fin is how to hold it in place on the tube temporarily before it is permanently secured by metallurgical bonding. A tube that is, say, 40 feet long may have about 3800 fins on it that must hold in place during the handling and bonding process. The fins must fit closely to the tube so that the zinc or brazing material can metallurgically bond between the two and conduct the heat from the tube into the fins. If there is an air gap between them after bonding, the tube will suffer a loss of heat conduction and thermal performance.

The new U-shaped fins are designed to hug the tube with a clamping force so that they do not move. The fins are machine-punched to a shape and size that is smaller than the tube width so that they must be inserted over the tube under force. When in place the fins are internally stressed and exert a clamping force onto the flat sides of the rectangular tube. The force is sufficient to allow the assembled fin-tube to be handled, moved, jarred, immersed in a molten zinc bath at 850 degrees fahrenheit and vibrated. The metallurgical bonding imparts physical strength to the fins, provides the metal contact between the tube and fin necessary for heat conduction and gives corrosion protection to the finned tubes for the atmosphere and its pollutants.

The fins are assembled and installed on the tubes without the use of any special machinery. The fins are hung on a pipe rack as they come off the punch press. They are then tightly packed by hand and a cradle-type jig forced over the top of them. The jig is then turned over, the pipe rack removed, a metal comb slipped between the fins and then finally a rectangular tube is forced into the open ends of the U-shaped fins. This completes the assembly and installation prior to their permanent metallurgical bonding. It is quick and low cost.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. I should be appreciated by those skilled in the art that the conception and the disclosed specific embodiment may be readily utilized as a basis for modifying or designing other structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a fuller description of the nature and objects of the invention, reference should be made to the following detailed descriptions taken in conjunction with the accompanying drawings in which.

DETAILED DESCRIPTION OF THE INVENTION

Figure 1:
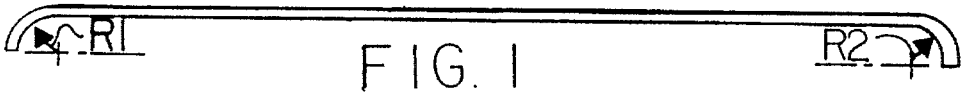
FIG. 1 is flat steel plate with rolled edges that represents one-half of a rectangular tube.

The object of this invention is to design a low-cost, air cooled, extended surface, steam condensing, heat exchange tube of the type that could be used in the single row bundle design disclosed in U.S. Pat. No. 5,139,083 or any other such single or two row bundle. The tube is rectangularly shaped and completely stacked with thin, closely spaced, U-shaped, heat transfer fins 12 of a three link design 14, 16 and 18. They are installed in place by forced insertion over the narrow side of the tube 10 with its two outer fin-links 16 and 18 held against the flat side-walls of the tube 10. They are held there by stress-induced clamping-forces "F" that are generated in the semi-circular middle fin-link 14 that is an abutting extension of the two long outer links 16 and 18. As a final step in this fabrication and assembly process the fins must be metallurgically bonded to the tubes such as hot-dip galvanizing or the like for reasons of strength, long-term heat-transfer reliability and corrosion protection.

A U-shaped fin that can be inserted in place over a rectangular shaped tube was chosen because it offers an efficient layout for metal stamping with little scrap losses; is readily stacked onto a rectangular tube that can be fabricated in-house; is flexible in its clamping direction and, therefore, self-adjusting as regards most tube dimensional tolerances so that there is no tube-finning production hang-ups; and is freeze protective of the condensate flowing on the bottom of the tube.

Figure 2:
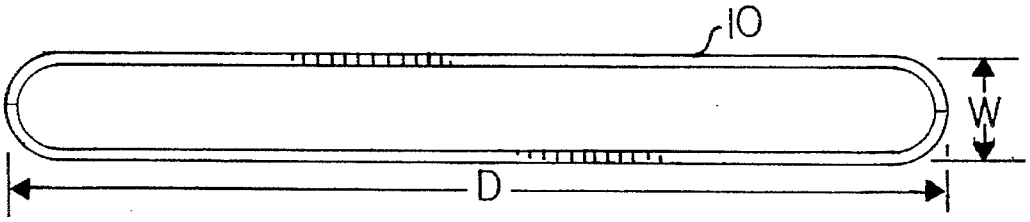
FIG. 2 are two FIG. 1 plates welded at the seams becoming a rectangular tube.
Figure 4:
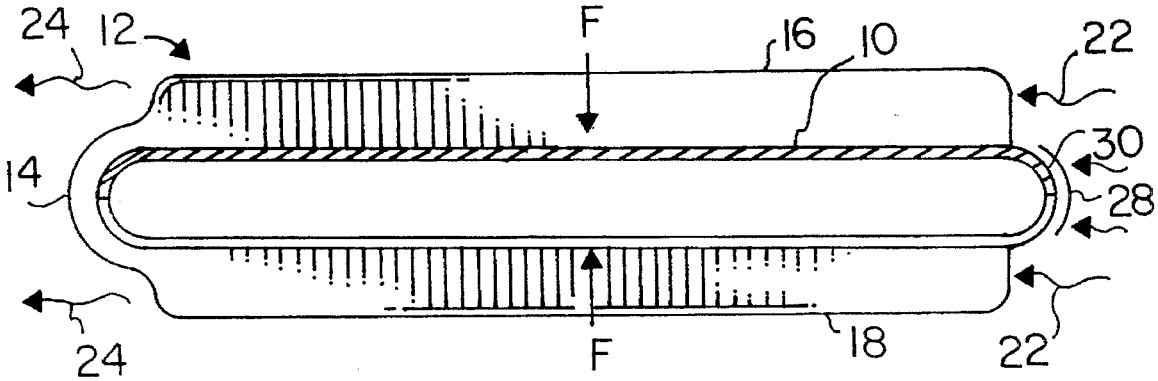
FIG. 4 is fin FIG. 3 pulled over tube FIG. 2.
Figure 5:
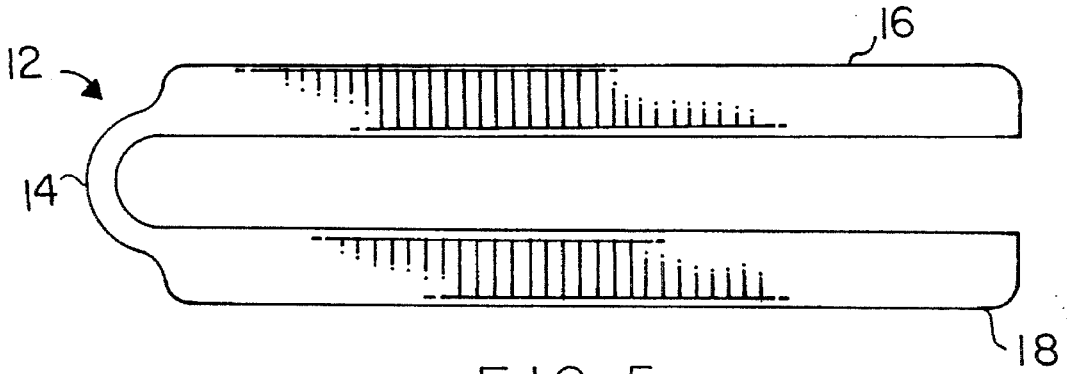
FIG. 5 is a thin fin punching with parallel outer links as contrasted to FIG. 3.

An in-house fabricated rectangular tube is shown in FIGS. 1 and 2. The sheet metal is purchased pre-cut and the ends are rolled as shown in FIG. 1. The two radii may be the same as shown in FIG. 4 or they may be different as shown in FIG. 5. Two FIG. 1 pieces welded at the seams make a rectangular shaped tube 10 shown in FIG. 2. The ends must be rounded as shown to guide and aid in the insertion of the fins onto the tube as can be noted where FIG. 3 fin with a narrow "w" opening dimension is inserted over a wider "W" dimension of FIG. 2 tube. For general power plant steam condensing applications the "D" dimension or tube depth may be in the range of 5 to 8 inches and the tube width "W" dimension is about ½ to 1 inch. The alternative to FIGS. 1 and 2 is to buy steel tubing and shape it in-house by mandrel drawing means.

Figure 3:
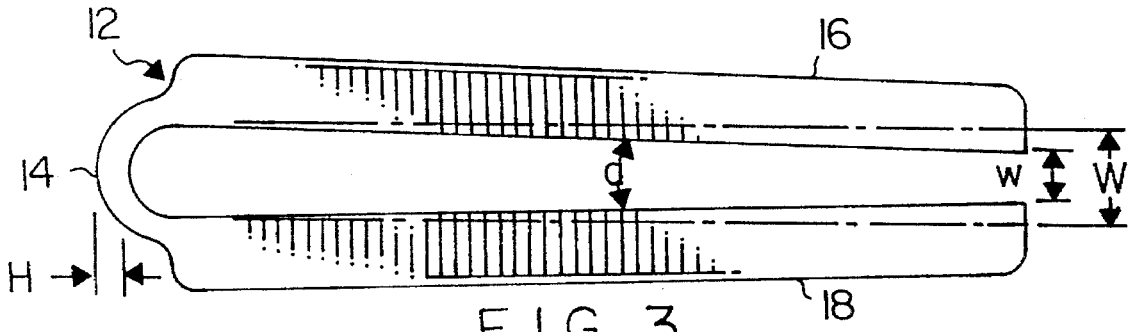
FIG. 3 is a thin fin punching with tapered outer links.
Figure 6:
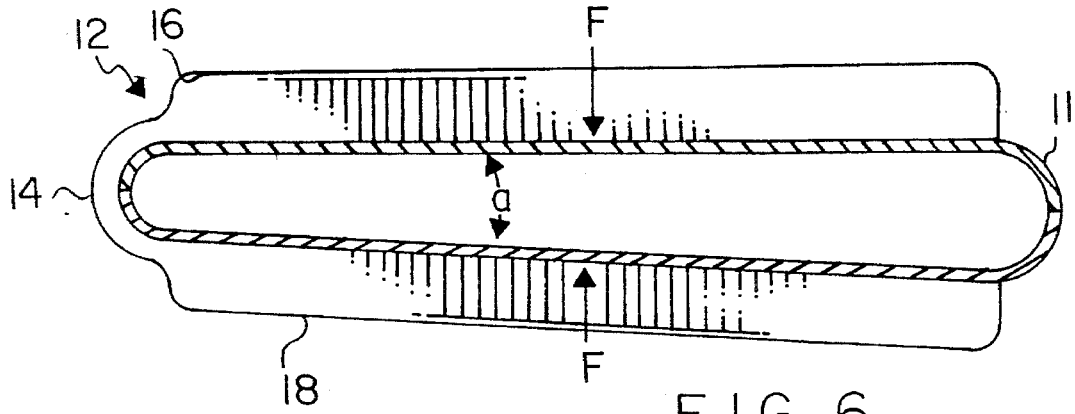
FIG. 6 is fin FIG. 5 pulled over a tapered tube.

FIGS. 3 and 5 show thin metal U-shaped fins 12 that are drawn in their normal unstressed condition. FIG. 3 has its two outer links 16 and 18 made with a slight tapered angle "A" between them. This fin would be installed over a tube 10 that has its flat surfaces parallel to each other as shown in FIG. 2. FIG. 5 has its two outer links 16 and 18 made parallel to each other and they would be installed over a tapered, tube 11 shown in FIG. 6. Or the FIG. 5 fin could be physically bent into a FIG. 3 fin for use on a FIG. 4 fin.

The key to this design of the U-shaped fin 14 is its unique ability to hold on to the tube 10 and 11 because of the internal stresses in the semi-circular link 14 that produce a reactive inward clamping force "F" that presses the two outer links 16 and 18 against the flat sides of the tube 10. This is the holding force that allows the fin-tube assembly to be handled, moved around and finally plunged into a hot zinc bath or placed into a brazing furnace for permanent metallurgical bonding.

The fabricated height dimension "H" of the semi-circular link 14 and the fabricated angle "A" between the two fin-links 16 and 18 control the internal stresses in the semi-circular link 14. This dimension and angle must be optimized to prevent the fin from bending or distorting under stress yet it must be large enough to provide sufficient clamping force "F" for holding purposes. These measurements and their accompanying forces are a function of fin thickness and fin length.

The rectangular finned tube drawn in a horizontal position in FIG. 4 is generally installed in practice in a vertically inclined position so that condensate flows downward on the semi-circular bottom of the tube 10. The semi-circle heat-transfer fin-link 14 is on top of the tube 10 while the bottom has no fins. The cold atmospheric air 22 enters from the bottom of the tube, travels between the fins 16 and 18 and is discharged as heated air 24 at the top. It is desired, for reasons of power cycle efficiency and freeze protection, that the condensate is returned to the plant as hot as possible both in winter and summer. For this reason the U-shaped fin is positioned with no heat transfer fins on the bottom of the tube.

Figure 7:
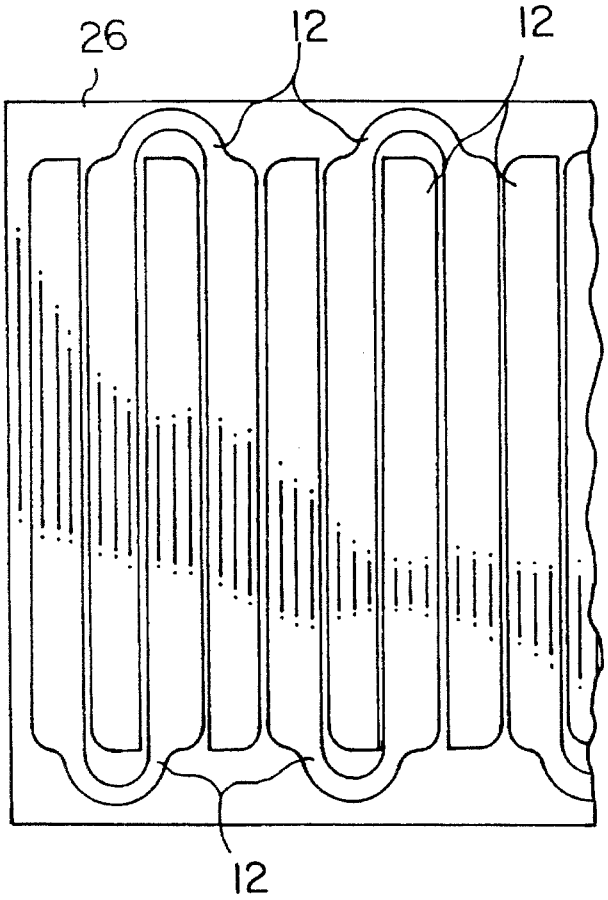
FIG. 7 is a layout of the fins that are to be machine punched from a commercial sheet-metal strip roll. Note the efficient layout of the U-fins and the small amount of scrap to be discarded.
Figure 11:
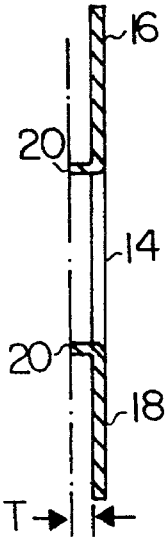
FIG. 11 is a sectional view of FIG. 8 that shows the bent footing of the two outer link fins.
Figure 12:
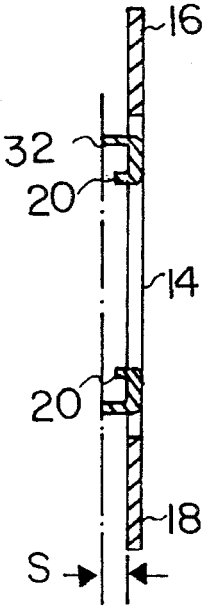
FIG. 12 is a sectional view of FIG. 8 showing the protruding spacer tabs that have been punched from the flat fin plates.
Figure 13:
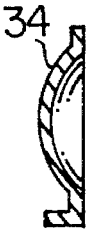
FIG. 13 is a sectional view of the dimple-type air-flow turbulators that are punched into the flat surfaces of the two outer links.

The heat exchange fins 12 are cut on a punch press from sheet metal strips 26 that may be purchased commercially in rolls to a specified width dimension. FIG. 7 shows the outline and arrangement of the fins that could be punched from the metal strip. The U-shaped configuration offers the opportunity for very efficient utilization of the metal strip with little scrap loss depending on the desired width of the fin-links 16 and 18 compared to the width "W" of the tube 10.

FIGS. 8 through 13 show the construction details of the fin 12 as cut on a punch press. The angled cutting with dimension "w" is the FIG. 3 fin while the parallel cutting with dimension "W" is the FIG. 5 fin. An alternate to stamping the fin as shown in FIG. 3 is to stamp the fin as shown in FIG. 5 and then physically bend it into the FIG. 3 shape. The three link fin 12 consists of the two footed fin-links 16 and 18 and the abutting semi-circular fin-link 14. Fin-links 16 and 18 are footed 20 to some dimension "T" to give them rigidity. Fin spacer tabs 32 are punched to serve as spacers between adjacent fins. Their protrusion dimension is "S" which is greater than the width of the fin foot "T". Fin-links 16 and 18 are covered with dimple-type air-flow turbulators 34 which improve the air-side heat transfer rate.

Figure 9:
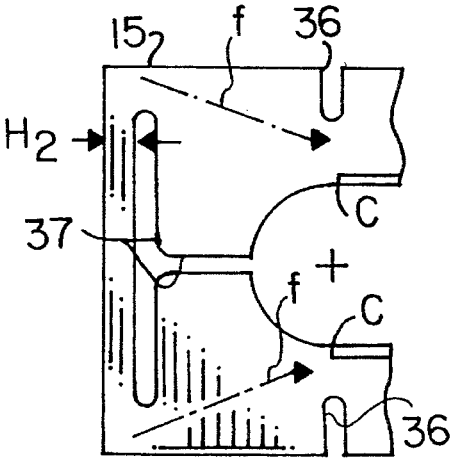
FIG. 9 shows an alternate design of the middle semi-circular link compared to FIG. 8.
Figure 8:
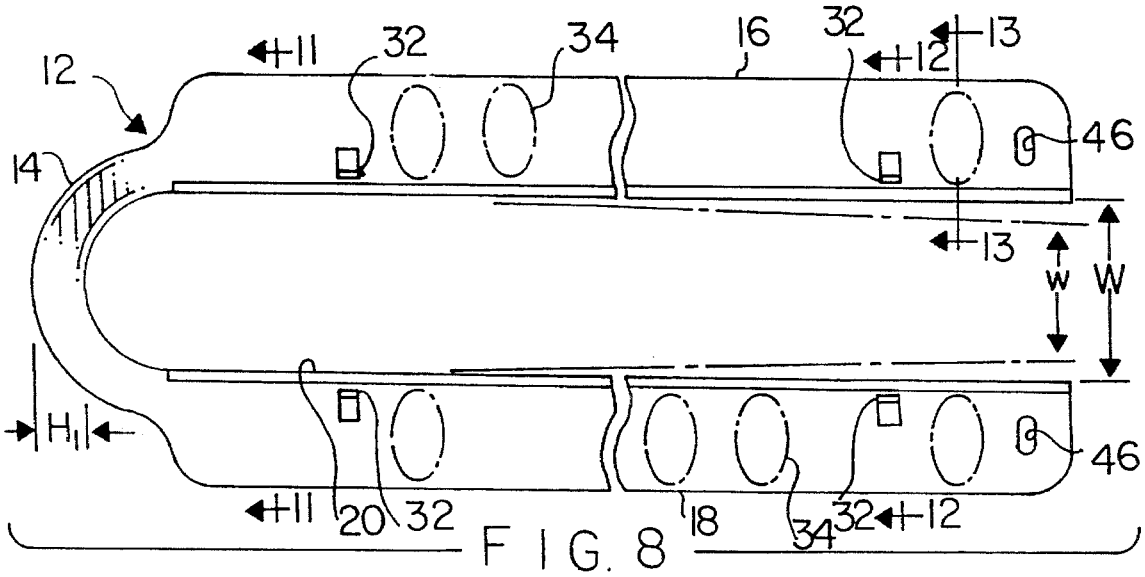
FIG. 8 is an enlarged and detailed view of a three link fin with "w" representing the fin-link position of FIG. 3 and "W" representing the fin-link position of FIG. 5.
Figure 10:
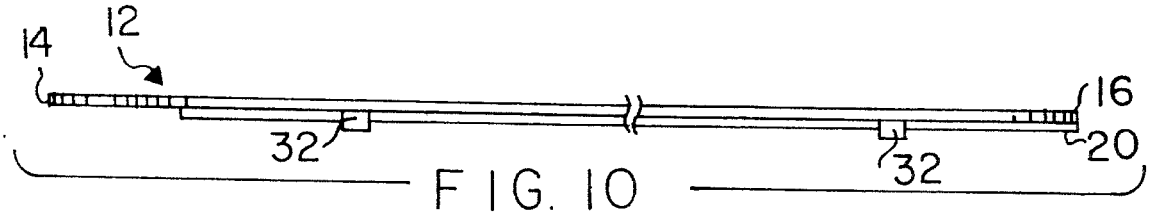
FIG. 10 is a top view of FIG. 8.
Figure 14:
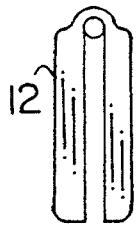
FIG. 14 shows the fins as received from the punch press being hung onto a pipe hanger for handling purposes.
Figure 15:
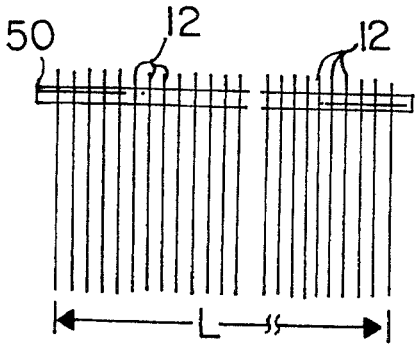
FIG. 15 shows the tightly packed find of length "L" hanging from the pipe hanger.
Figure 16:
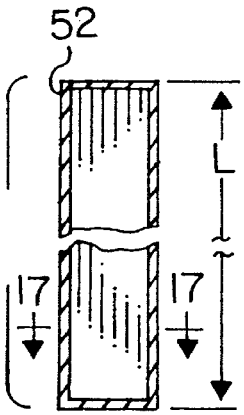
FIG. 16 is an inside view of the cradle-type jig.
Figure 17:
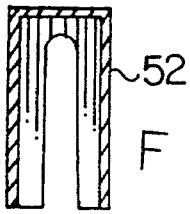
FIG. 17 is a sectional view of the cradle-type jig.
Figure 18:
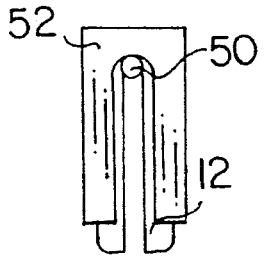
FIG. 18 shows an end view of the jig placed over the tubes.
Figure 19:
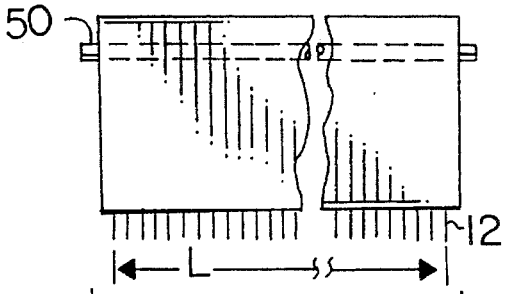
FIG. 19 shows a side view of the jig and the protruding fins.
Figure 20:
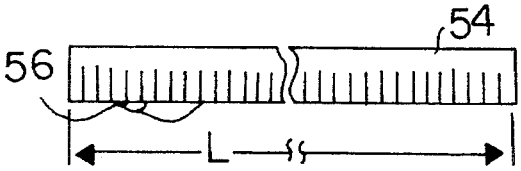
FIG. 20 shows a metal comb with saw cuts.
Figure 21:
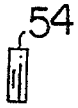
FIG. 21 is an end view of the metal comb.
Figure 22:
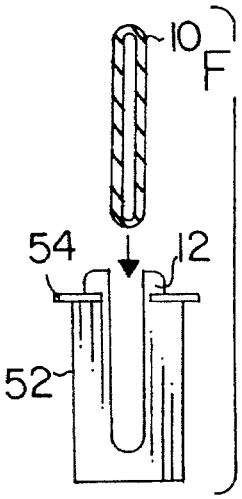
FIG. 22 if FIG. 18 turned around with the comb FIG. 20 placed on top of the jig ready to receive the rectangular tube.
Figure 23:
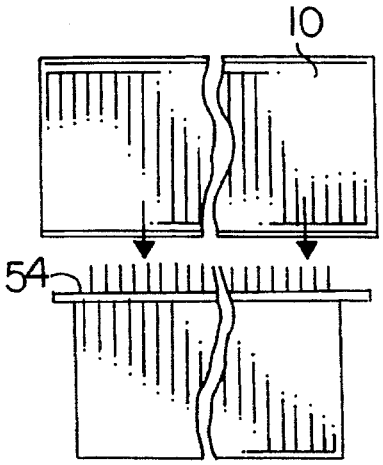
FIG. 23 is the side view of FIG. 22.
Figure 24:
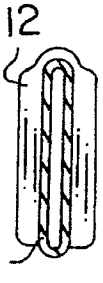
FIG. 24 is the end view of a finned tube.
Figure 25:
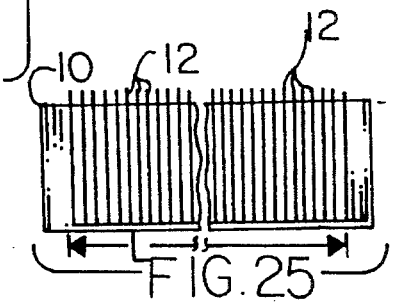
FIG. 25 is the side view of FIG. 24.

The heat transfer rate and the stress/force characteristics of fin-link 14 can be changed by changing its size and shape and introducing cuts such as 36 and 37 as shown in one example FIG. 9. Cuts 36 are made to direct and funnel the clamping forces "F" close to the foot 20 of the fin so as not to distort the shape of fins 16 and 18. Cuts 37 are made to control the stress level in middle fin-link 15. This stress level is determined in part by dimension "$H_2$" which is comparable to dimension "$H_1$" in fin-link 14 of FIG. 8. The ability of fin. 12 to cope with the tubes 10 dimensional manufacturing tolerances is greater for fin-link design 15 FIG. 9 than it is for fin-link design 14 FIG. 8 simply because the portion of the stressed link dimensioned "$H_2$" is located further out from the tube contact point "C". The assembly and insertion of the fins onto the tube is accomplished by tightly packing the individual fins into a cradle-type jig then forcing the narrow side of the rectangular tube into the open ends of the aligned U-shaped fins until the bottom of the tube strikes the middle fin-link. This procedure is shown in FIGS. 14 through 25. FIGS. 14 and 15 show the fins as received from the punch press being strung onto a pipe hanger 50. FIGS. 16 and 17 show a cradle-type constructed with internal dimensions close to those of fin 12. When enough fins 12 are strung on pipe hanger 50 to equal the length of the desired finned tube "L" then the cradle jig 52 is inserted over the top of these tightly packed fins as shown in FIGS. 18 and 19. The cradle jig and its fins are then turned around as shown in FIGS. 22 and 23 and the pipe hanger 50 removed. A metal comb 54, FIGS. 20 and 21, with fine saw-cuts 56 equal to the thickness of the fins and spaced the same as the fins is inserted between the fins as shown in FIGS. 22 and 23. This comb 54 provides accurate alignment and support for the fins 12 as the tube 10 is inserted into the jig 52. The tube 10 is forced down to the bottom of the fins 12 when the assembly is completed. The assembled finned tube of length "L" is removed from the jig 52 is shown in FIGS. 24 and 25. It is now ready for metallurgical bonding.

Figure 26:
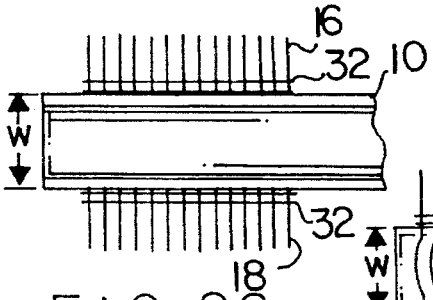
FIG. 26 is a cross sectional view of the narrow side of a tube showing the fins and tab spacers in place.
Figure 27:
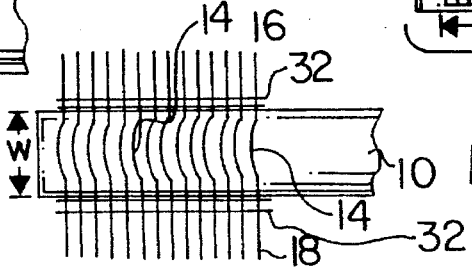
FIG. 27 is a top view of the narrow side of a tube showing the middle-fin links distorted in shape because of their internal stresses.

FIG. 26 is a sectional view of the tube 10, its footed fins and the spacer tabs 32. FIG. 27 is the same view directions FIG. 21 looking down on the semicircle fin-link 14. These fin-links 14 distort in shape as shown when the fin 12 is inserted over the tube 10. It is this metal distortion which produces the fin clamping force "F".

The finned tube described in this application could be used in the fabrication of multiple tube row bundles and the fin material could be either steel, aluminum or some other metal.

The small metal scrap losses achieved in the layout of the U-shaped fins onto the raw sheet metal plate as shown in FIG. 7 can also be achieved by the use of other layout arrangements. For example, a very efficient layout can also be made by press stamping only one-half of the U-shaped figure with the separation made in the center of the middle link. Two such companion half links of right and left hand orientation can then be joined by lapping their middle links then spot-welding the joint in the center to achieve the required slot/tube width dimensions. Another variation or change of the U-shaped fin may be made when the heat transfer design requires the use of a wider dimension is machine punched to accommodate the wide fin. In a subsequent operation the slot width dimension is decreased to fit the narrow tube by removing the excess metal in the center link by a mechanical fold.

The metallurgical bonding that follow could be hot-dip galvanizing, brazing, soldering, welding or the like that is compatible with the metals used. The tube flowing fluid can be either vapors, gases, liquids or any such combination thereof while the finned side of the heat exchanger could flow air, gases or vapors.

The present disclosure includes that contained in the appended claims as well as that of the foregoing descriptions. Although this invention has been described in its preferred form with a certain degree of particularity, it is understood that the present disclosure of the preferred form has been made only by way of example and numerous changes in the details of construction and combination and arrangement of parts may be resorted to without departing from the spirit and the scope of the invention.

Now that the invention has been described,

What is claimed is:

1. Apparatus for use in condensing steam, the apparatus including an elongated, air-cooled tube having a generally rectangular shape with flat side-walls and end-walls therebetween, the apparatus also including a plurality of thin, closely spaced, generally U-shaped, extended surface, heat transfer fins coupled to the tube in a completely stacked relationship, each fin being of a three-link design and with two outer fin-links and a middle fin-link therebetween as an abutting extension of the outer fin-links, the middle fin-link having an inner portion shaped to generally conform to the adjacent shape of the tube and having an outer portion curved to provide an optimized clamping force, with the fins held in place on the tube by the two outer fin-links clamped against the flat side walls of the tube by stress-induced forces generated in the middle fin-links as a result of the forced movement between one end-wall of the tube and the fins when assembled on the tube and means to permanently bond the fins to the tube in a separate metallurgical procedure.

2. The apparatus as set forth in claim 1 wherein the tube includes two large flat surfaces fabricated so as to be parallel with each other.

3. The apparatus as set forth in claim 1 wherein the tube includes two large flat surfaces fabricated with a slight tapered angle between them.

4. The apparatus as set forth in claim 1 wherein the end-walls are semi-circular in shape to guide and aid when inserted a tapered fin onto the tube.

5. The apparatus as set forth in claim 1 wherein the end walls of the tube include a first semi-circular end and a second semi-circular end and there are fins located on the first semi-circular end whereat heated air may leave the tube but there are no fins on the second semi-circular end of the tube whereat ambient air may enter.

6. A U-shaped, three-link fin fabricated of a heat-transfer material insertable in place over a generally rectangular-shaped tube having diverging opposite tube walls forming a narrow side and a wide side, the insertion being by the movement of the fin over the narrow side of the tube through the use of a small force, the fin having two outer fin-links and a middle link therebetween, the middle link being designed to become internally stressed when the fin is forced in place over the tube and, being stressed, then exerts a reactive inward clamping force to hold the two outer fin-links against opposite tube walls, the middle link being shaped internally to generally conform to the tube shape thereadjacent and being sized and cut externally to produce an optimized clamping force, and wherein the middle link is semi-circular with a height-dimension and angle between the outer fin-links being optimized by design to produce a maximum clamping force without distorting the fins by extraneous internal stresses.

* * * * *